United States Patent [19]

Brown

[11] 4,215,444

[45] Aug. 5, 1980

[54] SHOWER STALL

[76] Inventor: William T. Brown, 206 Westwood 5th Ave., McMinnville, Tenn. 37110

[21] Appl. No.: 35,241

[22] Filed: May 2, 1979

[51] Int. Cl.[3] ..... A47K 3/22

[52] U.S. Cl. ..... 4/612; 4/613

[58] Field of Search ..... 4/145, 146, 2, 3, 149, 4/154, 153

[56] References Cited

U.S. PATENT DOCUMENTS

| | | | |
|---|---|---|---|
| 1,901,151 | 3/1933 | Druckanmiller | 4/146 |
| 2,650,368 | 9/1953 | Evans | 4/2 |
| 3,060,453 | 10/1962 | Swan | 4/146 |
| 3,066,311 | 12/1962 | Tharp | 4/3 |
| 3,132,350 | 5/1964 | Carlson | 4/146 |
| 3,457,568 | 7/1969 | Amatruda | 4/146 |

*Primary Examiner*—Henry K. Artis

*Attorney, Agent, or Firm*—James C. Kesterson; Robert E. Pitts

[57] ABSTRACT

A doorless shower stall which confines water such that it cannot be sprayed nor splashed outside of the stall is disclosed. The stall includes a shower chamber area which is enclosed except for an entry passage to the shower chamber. Connected to the shower chamber area by the entry passage is an antechamber having a primary entry way which leads outside of the shower stall and which primary entry way is substantially perpendicular to the entry passage into the shower chamber. In a preferred embodiment, the shower stall is manufactured of molded fiberglass or other material which includes a floor which slopes such that water in the antechamber runs away from the primary entry way and through the entry passage into the shower chamber. The floor of the shower chamber is itself sloped toward a drain located at a desired location in the shower chamber. The shower stall may further include a molded fiberglass cap or ceiling to further prevent escaping moisture from causing damage outside of the shower stall.

7 Claims, 4 Drawing Figures

SHOWER STALL

BACKGROUND OF THE INVENTION

The present invention relates to shower stall enclosures in general and more particularly to a shower stall enclosure which prevents the escape of splashed or sprayed water without the use of a door or curtain.

Shower stalls are, of course, well known, and various configurations have been used in homes and institutions, etc., as a means of bathing the human body for centuries. It will also be appreciated that free standing shower stalls having various types of construction, including molded fiberglass shower stalls and bath tub/-shower combination units have also been used in the construction of many modern and new homes. All of the prior art stalls, however, typically have one or more objectionable characteristics, which characteristics are eliminated by the shower stall of the present invention. For example, the standard prior art free standing shower stall was typically a structure completely enclosed except for a door or entry way. This entry way was then sealed off by either a folding or swinging door and in some instances by a curtain. It will be appreciated, however, that the use of curtains is not usually satisfactory for completely preventing the escape of water from a shower stall as it splashes up around the bottom of the curtain and around the sides. Furthermore, such shower curtains are typically pushed aside and hang in pleats once the shower is out of use such that these pleats prevent the complete drying of the shower curtain and allow for the formation of mold, fungus, odors, etc. Likewise, doors whether folding or of a swinging type typically require the use of tracks and/or moldings which are used to help seal the door to prevent the escape of water. These tracks, however, also provide a point of water pooling and help in the creation of odors, mold, fungus and the like. Furthermore, if one is careless in using the standard shower stall, the door and/or curtain may not be completely closed and even greater amounts of water will escape and possibly cause damage to the exterior or the room in which the shower stall is located. Thus, although shower stalls have been used for years, little has been done to improve the ability of the shower stall to prevent water and moisture from escaping and possibly causing damage to surrounding structures.

An investigation into some of the prior art related to the field of shower stalls revealed no reference that was significantly relevant to this invention. One reference, U.S. Pat. No. 3,852,834 issued to Earl Laverne Morris on Dec. 10, 1974 is concerned with a modular combination plumbing fixture having a unitary shower enclosure with a single entrance and a shower head mounted on the frame of the entrance such that water cannot be sprayed outside of the shower door. The shower stall of this invention is primarily for use in institutions such as penal institutions wherein the requirements of unusual strength and resistance to intentional damage and destruction is of prime importance. This shower stall, of course, in no way prevents the escape of moisture and water splashed outside of the stall unit. Furthermore, although the shower stall disclosed by this patent may well be of great value with respect to the use in penal institutions and the like, it in no way solves any of the problems for preventing the development of fungus, molds, odors and the like as was discussed, heretofore.

U.S. Pat. No. 3,905,048 issued to Hans Gunter Moller on Sept. 16, 1975 discloses a method for producing molded sanitary cells from thermoplastic panels by deep drawing the panels to obtain intragally molded parts. More particularly, the disclosure in this patent is concerned with providing a unitary molded unit containing all of the sanitary fixtures of a bathroom including the toilet, the bath tub, and a wash basin. Therefore, although this patent does describe and illustrate the use of plastics and such materials in producing bathroom and water-resistent units, it in no way discloses or teaches a device which prevents the escape of splashed or sprayed water from the shower stall during the process of taking a shower.

U.S. Pat. Nos. 3,940,806, and 3,895,398 issued to Bernard Mustee on Mar. 2, 1976, illustrate a free standing shower stall including a base, wall panels, a rail, etc., which uses water-tight hinges such that the side panels may be folded into a small compact unit for shipment prior to installing at its permanent site. Further, although these patents disclose several ways of joining panels to fabricate a shower stall, the shower stall in this patent uses a conventional shower door and/or curtain arrangement to prevent water from escaping from the shower stall unit itself. Thus, although the shower stall of disclosed in this patent could be of significant benefit as far as compact storage is concerned prior to installation, it in no way overcomes any of the shortcomings discussed heretofore with respect to reducing the collection of water which results in odors, fungus and mold.

U.S. Pat. No. 3,984,880 issued to Arnold F. Schrameyer on Oct. 12, 1976, discloses a plastic water guard unit for use with a shower/tub combination. The water guard unit works in combination with the shower curtains to help prevent water from escaping around the edges of the shower curtain. However, these guard units in no way prevent the collection of moisture on the shower curtain itself and in part provide even further collection points where water may collect with a resulting increase in odors, fungus, mold and the like.

SUMMARY OF THE INVENTION

Therefore, it is an object of the present invention to provide a simple and inexpensive shower stall which prevents water from escaping the shower stall unit without the use of doors or shower curtains.

It is a further object of this invention to provide a shower stall which helps eliminate or reduce the pooling of water which results in the breeding of mold, bacteria, odors and the like.

It is still another object of this invention to provide a shower stall which collects water dripping from a recently bathed person and routes the water back into the shower stall for disposal down the drain.

It is still another object of the present invention to provide a shower stall which substantially reduces damage to surrounding structures, carpets and other items which are not water resistent.

Briefly, the shower stall of this invention comprises a shower chamber enclosed on all sides except for a entry passage. An antechamber is connected to said shower chamber by means of said entry passage. And said antechamber is itself enclosed on all sides except for a primary entry way into the shower stall which primary entry way is substantially perpendicular to said entry passage into the shower chamber. In a preferred embodiment, the unit is molded from fiberglass into a unitary unit and further includes a floor. The floor of the shower stall includes a section of the flooring in said shower chamber which slopes toward a drain located at a desired location. The antechamber includes a second section of flooring which slopes from the primary entry way to the entry passage in the shower chamber.

DESCRIPTION OF THE INVENTION

Figure 1:
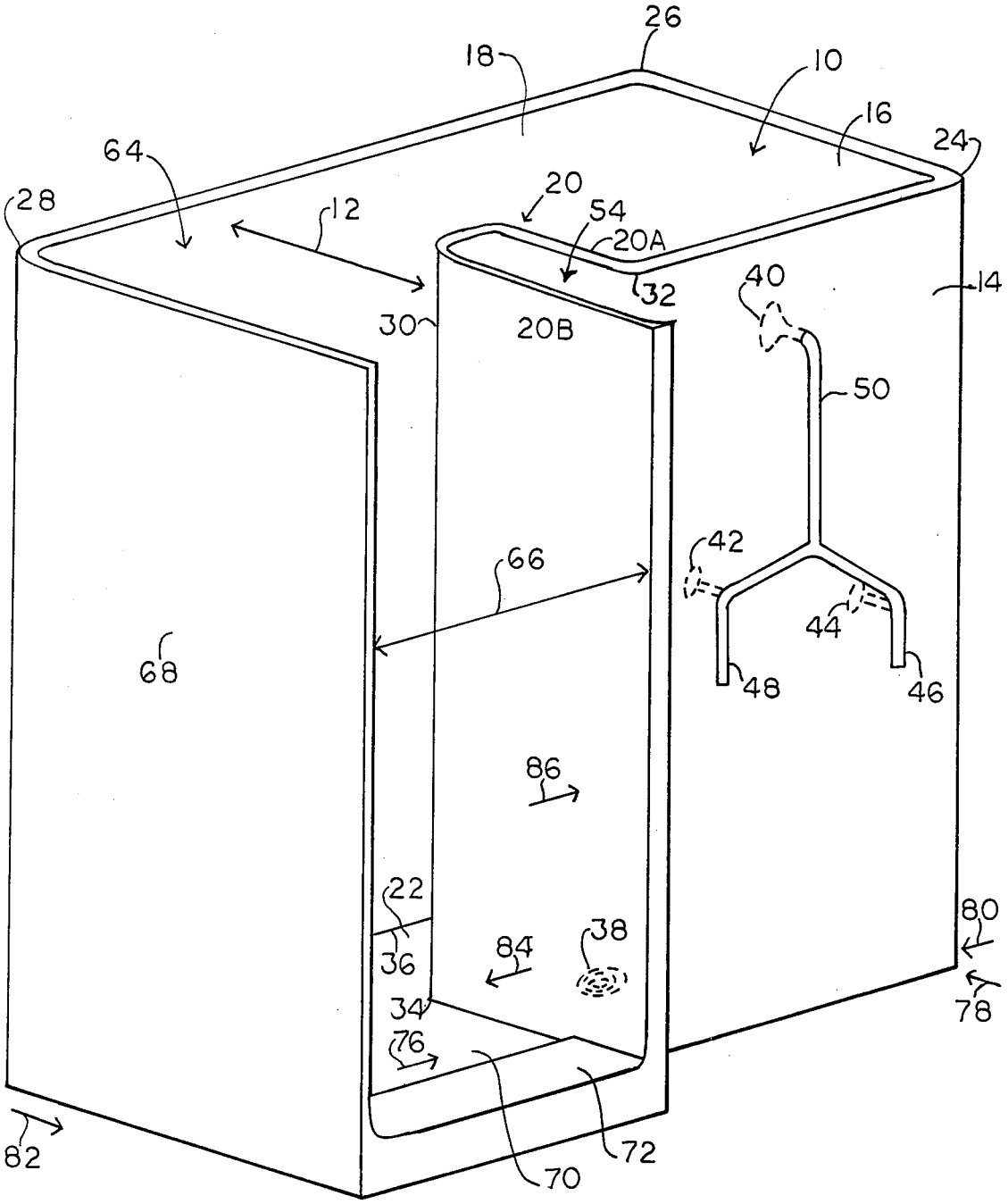
FIG. 1 is a perspective view of one of a preferred embodiment of the shower stall of this invention without a cap or ceiling.
Figure 3:
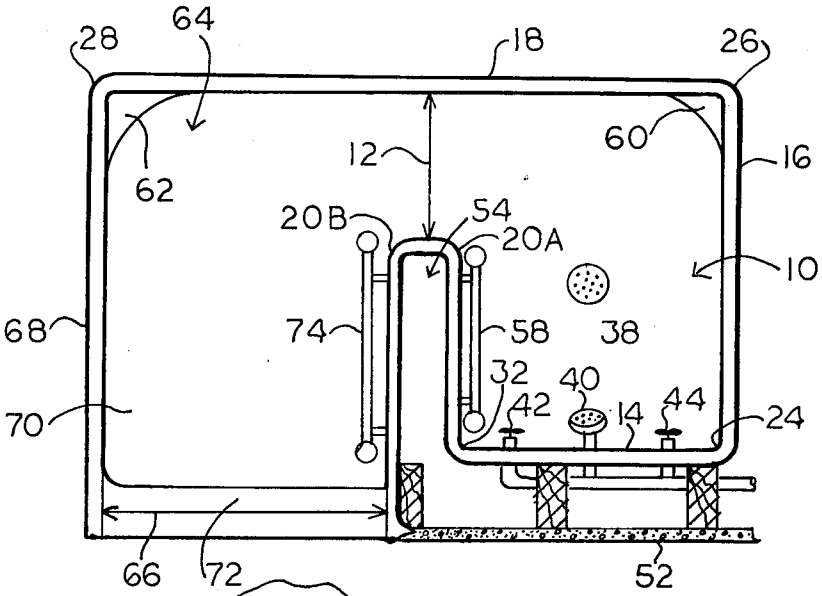
FIG. 3 is a top view of the shower stall of this invention without the cap or ceiling.
Figure 4:
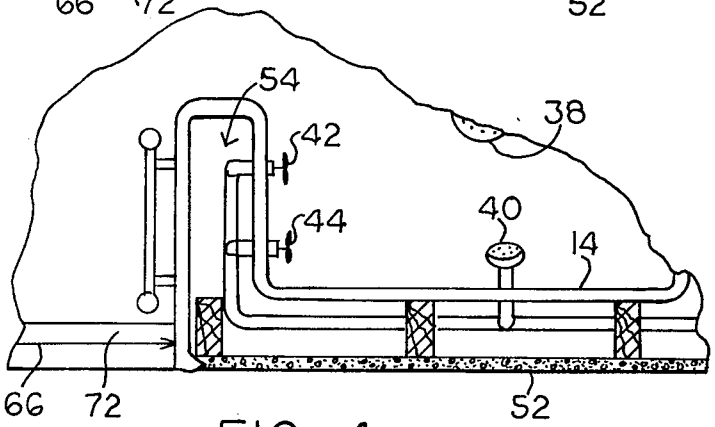
FIG. 4 is a partial top view of this invention showing an alternate placement of the shower control valves.
Figure 2:
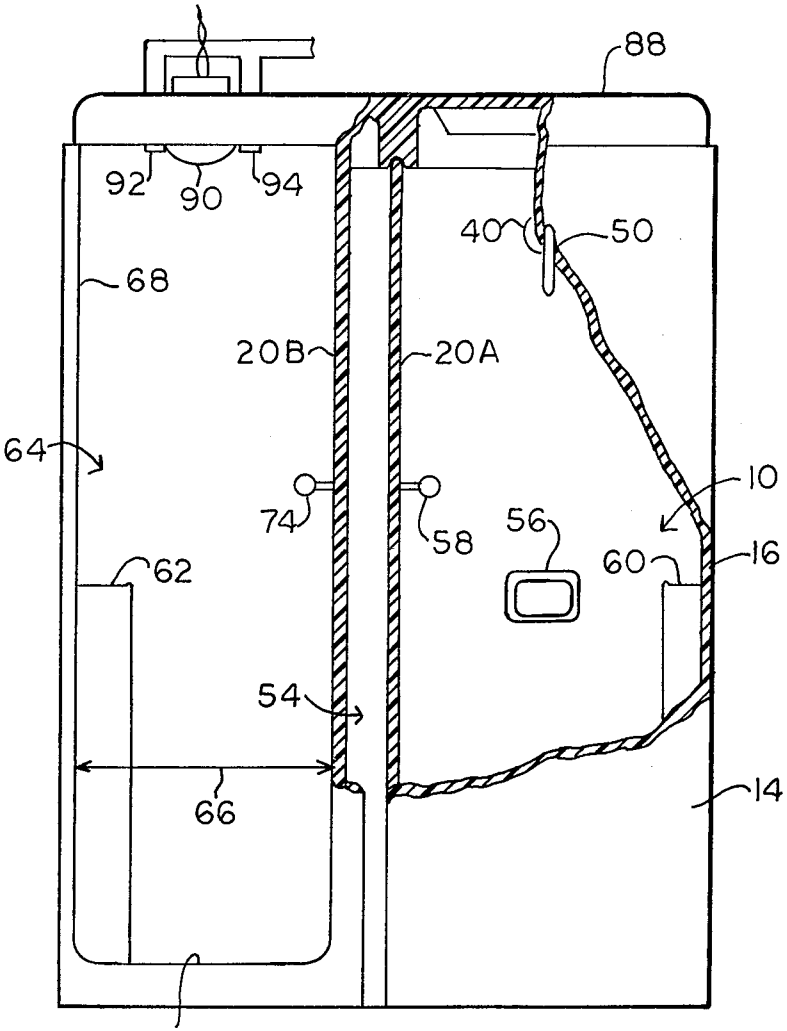
FIG. 2 is a front elevation, partially cut away view of the shower stall of this invention with a cap or ceiling.

Referring now to FIG. 1 there is shown a preferred embodiment of the shower stall of this invention. As shown, the shower stall includes a shower chamber 10 where in the actual bathing takes place. Shower chamber 10 is a chamber completely enclosed on all sides except for an entry passage represented by double headed arrow 12. In the embodiment shown in FIG. 1, shower chamber 10 is enclosed by front wall 14, side wall 16, back wall 18 and a hollow splash wall 20 having two panels 20A and 20B. Also included as part of the shower chamber structure is a floor 22. It should also be noted, that the juncture of any two wall surfaces, or wall surfaces and floor, is curved or coved such as shown at 24, 28, 30, 32, 34, and 36. The absence of right angle surface joints further prevents the accumulation or pooling of water. The heretofore described details may become more clear by also referring to FIGS. 2 and 3 which are front and top views respectively of the perspective view of FIG. 1. Included in shower chamber 10 is, of course, suitable draining means such as shown at 38. Also included are a shower head 40 and hot and cold water control valves 42 and 44. It will, of course, be appreciated that the type of shower head and whether a single lever water control valve commonly known in the art is used, or whether separate hot and cold water control valves are used as shown in FIG. 3 is a matter of choice. In the embodiment shown in FIGS. 1 through 3, shower head 40 and controls 42 and 44 are shown as being mounted on wall 14 such that the supply pipes 46, 48 to the controls and 50 to the shower head run out-side of the panel 14. In such an embodiment, a standard stud and plaster wall such as shown at 52 in FIG. 3 is typically used to enclose the supply pipes 46, 48 and 50 leading to the controls and shower head. Alternately, as shown in FIG. 4, the supply pipes 46 and 48, and controls 42 and 44 may be contained in a service area 54 formed in splash wall 20 between panels 20A and 20B. In the embodiment of FIG. 4, shower head 40 remains at the same location. It will also be appreciated of course that the shower head and control valves could be installed in other locations such as wall 16, for example. In such arrangements, the double wall structure of splash wall 20 could be used for wall 16. Other fixtures and accessories may also be included within the shower chamber 10 if desired. For example, as is shown in the FIG. 2, soap dish 56 may be attached thereto. Likewise, towel or grasp bar 58 may also be included in a desired location. A soap dish and shelf such as shown at 60 and 62 respectively in FIGS. 2 and 3 may also be molded into the fiberglass shower stall.

It will be appreciated, of course, that the floor 22 of shower chamber 10 slopes towards the drain 24 so that water will not collect or stand in the shower chamber.

Attached to and as an intragal part of this invention is an antechamber 64 which is connected to shower chamber 10 by means of entry passage 12. As can be seen, antechamber 64 is substantially enclosed on three sides and leads to the exterior of the shower chamber by primary entry way represented by arrow 66. as can be seen, the antechamber 64 is comprised by an extension of back panel or wall 18 of the shower chamber 10, panel 20B of splash wall 20 which serves as a common wall between shower chamber 10 and antechamber 64 and additional side wall 68. Also included is a floor 70 which slopes from a threshold 72 toward entry passage 12 so that any water collecting on the floor 70 will run into shower chamber 10. Antechamber 64 may also include such accessories as towel bar 74 which of course may be positioned at any desired location. As will be appreciated by those skilled in the art, an antislip surface may also be placed on floor 70 and floor 22 if desired.

It will be appreciated that the shower stall of this invention may be made of any suitable water resistant materials including tiles, formicas, etc. However, for economy and ease of construction a preferred embodiment of the present invention is to fabricate the shower stall from fiberglass and/or molded acrylic plastics to form a unitary unit which may be installed without excessive installation costs. However, to fabricate a shower stall of fiberglass or molded acrylic plastic, it will be necessary that approximately a one half (½) inch inward slope from top to bottom of all full length panels such as panels 14, 16, 18, 20 and 68 be used. This very slight slope allows the mold or plug to be withdrawn from the formed unit. For example, panel 68 will slope inward from top to bottom by one half inch for the entire panel height in a direction indicated by arrow 76. Likewise, panels 14, 16, 18, 20A and 20B will also slope inward from top to bottom by one half inch in a direction indicated by arrows 78, 80, 82, 84 and 86, respectively.

In addition, it will be appreciated that even though the shower stall as shown in FIG. 1 through 3 may be installed without a cap 88, in the preferred embodiment as shown in FIG. 2, a cap 88 is included. Cap 88, is made of the same molded material as the shower stall structure itself, and fits tightly with respect to panels 14, 16, 18, 20 and 68 to provide a water tight ceiling. It may be particularly desirable to include with cap 88 a heat or drying lamp 90 and exhaust vents 92 and 94. Shown on the top of cap 88 are suitable wiring and venting connections.

Although the shower stall of this invention has been described as a substantially rectangular shape unit, it will be appreciated that any desired shape such as an elongated oval or a spiral (not shown) is included in the scope of this invention.

Thus, although the present invention has been described with respect to specific embodiments, it is not intended that such specific references be considered as limitations on the scope of this invention except insofar as is set forth in the following claims.

What is claimed is:

1. A shower enclosure for reducing or eliminating mold and odors by reducing or eliminating pooling locations, and for reducing water damage to structures, rugs, floors, walls and the like surrounding said enclosure by reducing water splashed outside of said enclosure without the use of curtains or doors, said enclosure comprising:

a shower chamber having an entry passage, and including a shower chamber floor member and a plurality of substantially vertical walls which enclose a space defining said shower chamber, said plurality of walls being smoothly joined to each other and smoothly joined to said floor member such that all junctures form curved or coved corners to eliminate the pooling or gathering of water, said floor member sloping for purposes of directing water to a drain aperture defined by said floor member, and a portion of said enclosing walls defining said entry passage, the edges of said entry passage being curved and smooth to reduce the pooling or gathering of water; and an antechamber having a primary entry way and being smoothly connected to said shower chamber by said entry passage, said antechamber including an antechamber floor member and a plurality of substantially vertical walls which enclose a space defining said antechamber, said plurality of walls being smoothly joined to each other and smoothly joined to said antechamber floor member such that all junctures form curved or coved corners to eliminate the pooling or gathering of water, said enclosing walls defining said entry passage and said primary entry way and said primary entry way being positioned at a selected location in said enclosing walls with respect to said entry passage such that water splashed out of said shower chamber through said entry passage cannot continue unobstructed through said primary entry passage and out of said antechamber, and said antechamber floor member being smoothly joined with said shower chamber floor member at said entry passage and sloping such that water falling on said antechamber floor member runs out of said antechamber through said entry passage onto said shower chamber floor member and then to said drain aperture.

2. A shower enclosure for reducing or eliminating mold and odors by reducing or eliminating pooling locations, and for reducing water damage to structures, rugs, floors, walls and the like surrounding said enclosure by reducing water splashed outside said enclosure without the use of curtains or doors, said enclosure comprising:

a unitary unit molded from material selected from the group consisting of fiberglass and acrylic plastic, said unitary unit comprising, a shower chamber having an entry passage and including a shower chamber floor member and a plurality of substantially vertical walls which enclose a space defining said shower chamber, said plurality being smoothly joined to each other and smoothly joined to said floor member such that all junctures form curved or coved corners to eliminate the pooling or gathered of water, said floor member sloping for purposes of directing water to a drain aperture defined by said floor member, and a portion of said enclosing walls defining said entry passage, the edges of said entry passage being curved and smoothed to reduce the pooling or gathering of water, and an antechamber having a primary entry way and being smoothly connected to said shower chamber by said entry passage, said antechamber including an antechamber floor member and a plurality of substantially vertical walls which enclose a space defining said antechamber, said plurality of walls being smoothly joined to each other and smoothly joined to said antechamber floor member such that all junctures form curved or coved corners to eliminate the pooling or gathering of water, said enclosing walls defining said entry passage and said primary entry way and said primary entry way being positioned at a selected location in said enclosing walls with respect to said entry passage such that water splashed out of said shower chamber through said entry passage cannot continue unobstructed through said primary entry passage and out of said antechamber, and said antechamber floor member being smoothly joined with said antechamber floor member at said entry passage and sloping such that water falling on said antechamber floor member runs out of said antechamber through said entry passage onto said shower chamber floor member.

3. A shower enclosure for reducing or eliminating mold and odors by reducing or eliminating pooling locations, and for reducing water damage to structures, rugs, floors, walls and the like surrounding said enclosure by reducing water splashed outside of said enclosure without the use of curtains or doors, said enclosure comprising:

a shower chamber having an entry passage, said shower chamber including, a plurality of substantially vertical walls, each having a top edge, two formed side edges, and a formed bottom edge, said plurality of walls smoothly joined at said formed side edges to enclose a space defining said shower chamber such that said bottom edges define an area having a first selected shape, one of said vertical walls being common with an antechamber wall, said common wall further defining said entry passage, and wherein the juncture of said formed side edges define coved or curved corners to eliminate the pooling or gathering of water, a shower chamber floor member having edges which define an outline corresponding to said first selected shape and said floor member edges being formed such that when smoothly joined to said bottom edges of said vertical walls, the juncture between said floor member and said walls define curved or coved corners to eliminate the pooling or gathering of water, said floor member sloping for purposes of directing water to a drain aperture defined by said floor member; and an antechamber having a primary entry way and being smoothly connected to said shower chamber by said entry passage, said antechamber including, a plurality of substantially vertical walls, each having a top edge, two formed side edges, and a formed bottom edge, said plurality of walls smoothly joined at said formed side edges to enclose a space defining said antechamber such that said bottom edges of said antechamber walls define an area having a second selected shape, one of said antechamber walls being said wall common with said shower chamber and wherein the edges defining said entry passage of said common wall are curved to eliminate collection points for the pooling of water, and wherein the juncture of said formed side edges define curved or coved corners to eliminate the pooling or gathering of water, said antechamber enclosing walls defining said primary entry way, and said primary entry way being positioned at a selected location in said enclosing walls with respect to said entry passage such that water splashed out of said shower chamber through said entry passage cannot continue unobstructed through said primary entry passage and out of said antechamber, and an antechamber floor member having edges which define an outline corresponding to said second selected shape, and said floor member edges being formed such that when smoothly joined with said bottom edges of said vertical walls, the juncture between said floor member and said walls define curved or coved corners to eliminate the pooling or gathering of water, said antechamber floor member being smoothly joined at said entry passage with said shower chamber floor member, and said antechamber floor member sloping such that water falling on said antechamber floor runs out of said antechamber through said entry passage onto said shower chamber floor member.

4. The shower stall of claim 1, 2 or 3 wherein said shower chamber is substantially rectangular shaped and said plurality enclosing walls include a first, second, third and splash wall, said first wall positioned substantially perpendicular to said splash wall and said second wall, said second wall being further positioned substantially perpendicular with said third wall, said splash wall defining said entry passage, and wherein said antechamber is substantially rectangular, said antechamber plurality of enclosing walls comprising said splash wall which is common between said antechamber and said shower chamber, said third wall which extends beyond said shower chamber, and a fourth wall positioned substantially perpendicular to said third wall.

5. The shower stall of claims 1, 2 or 3 and further including a shower head and a water control valve.

6. The shower stall of claim 1, 2 or 3 and further including a cap structure which provides a substantial water tight ceiling to said shower stall.

7. The shower stall of claim 3 wherein said shower stall is a unitary unit molded from a material selected from the group consisting of fiberglass and acrylic plastic and wherein each enclosing wall of said shower chamber and said antechamber slopes inwardly such that the form used in molding said unitary unit may be easily removed.

* * * * *